US006607421B1

(12) United States Patent
Rossi

(10) Patent No.: US 6,607,421 B1
(45) Date of Patent: Aug. 19, 2003

(54) FOLDING STRUCTURE

(76) Inventor: Deborah W. Rossi, 31 Oakes Rd., Rumson, NJ (US) 07760

( * ) Notice: Subject to any disclaimer, the term of this patent is extended or adjusted under 35 U.S.C. 154(b) by 149 days.

(21) Appl. No.: 09/760,395

(22) Filed: Jan. 12, 2001

Related U.S. Application Data

(60) Provisional application No. 60/177,457, filed on Jan. 20, 2000.

(51) Int. Cl.[7] ..... A63H 3/52

(52) U.S. Cl. ..... 446/478; 446/487; 52/71; 52/79.5

(58) Field of Search ..... 446/478, 75, 108, 446/109, 110, 487; 52/71, 79.5, DIG. 13

(56) References Cited

U.S. PATENT DOCUMENTS

| | | | | | |
|---|---|---|---|---|---|
| 243,873 | A | | 7/1881 | Dorn et al. | |
| 1,340,047 | A | | 5/1920 | Hansen | |
| 1,343,065 | A | | 6/1920 | Suyehiro | |
| 1,572,659 | A | | 2/1926 | Larkin | |
| 1,867,374 | A | | 7/1932 | Myers | |
| 1,899,241 | A | * | 2/1933 | Marr | 446/79 |
| 2,428,628 | A | | 10/1947 | Keston | |
| 3,078,615 | A | | 2/1963 | Smith | |
| 3,182,420 | A | | 5/1965 | Bender | |
| RE26,642 | E | | 8/1969 | Bender | |
| 3,597,858 | A | * | 8/1971 | Ogsbury et al. | 446/115 |
| 3,719,001 | A | * | 3/1973 | Archer | 446/476 |
| 4,011,682 | A | | 3/1977 | Ach | |
| 4,067,137 | A | | 1/1978 | Korthase | |
| 4,070,789 | A | * | 1/1978 | Levenson | 446/478 |
| 4,306,371 | A | * | 12/1981 | Walmer et al. | 446/110 |
| 4,467,572 | A | * | 8/1984 | Somers et al. | 52/70 |
| 4,508,519 | A | * | 4/1985 | Becker | 446/478 |
| 4,755,159 | A | * | 7/1988 | Templeton et al. | 446/478 |
| 4,883,443 | A | | 11/1989 | Chase | |
| 4,884,988 | A | * | 12/1989 | McMurray | 160/135 |
| 4,978,301 | A | * | 12/1990 | Dodge | 446/901 |
| 5,162,010 | A | * | 11/1992 | Krebs | 446/112 |
| 5,423,709 | A | | 6/1995 | Summers | |
| 5,482,490 | A | * | 1/1996 | Weldon-Ming | 446/478 |
| 5,707,269 | A | * | 1/1998 | Murphy | 446/901 |
| 6,108,982 | A | * | 8/2000 | Davison | 446/478 |
| 6,146,238 | A | * | 11/2000 | Daiber | 446/476 |

FOREIGN PATENT DOCUMENTS

| | | | | |
|---|---|---|---|---|
| CA | 700976 | A | * 12/1964 | |
| CA | 747616 | A | * 12/1966 | |
| CA | 2177500 | A | * 11/1997 | A63H/33/16 |
| DE | 922215 | A | * 11/1954 | |

(List continued on next page.)

OTHER PUBLICATIONS

Printout from Amazon.com: Toys/Categories/Dolls/Dollhouses and Miniatures section of website showing various dollhouses and accessories, 9 pages, copyright 1996–2001.

Amazon.com Catalog pp. 31–34, showing various dollhouses, (publication date unknown, but believed to be as early as 1996).

*Primary Examiner*—Derris H. Banks
*Assistant Examiner*—Urszula M Cegielnik
(74) *Attorney, Agent, or Firm*—Sitrick & Sitrick

(57) ABSTRACT

A foldable structure having an assembled configuration and a folded configuration. The foldable structure includes a main portion, a base panel which supports the main portion and a stabilizing panel which attaches to the main portion to stabilize the structure when in the assembled configuration. The foldable structure preferably includes at least one removable intermediate section which partition the space defined by the assembled main portion. Additionally, the foldable structure is preferably provided with anti-tip members which secure the main portion to the base panel so as to prevent the main portion from tipping away from the base panel.

65 Claims, 10 Drawing Sheets

FOREIGN PATENT DOCUMENTS

| | | | | | |
|---|---|---|---|---|---|
| DE | 2437747 | A | * | 2/1976 | ..... A63H/33/14 |
| DE | 29704347 | U1 | * | 5/1997 | ..... A63H/3/52 |
| DE | 29719499 | U1 | * | 12/1997 | ..... A63H/3/52 |
| EP | 0555188 | A1 | * | 8/1993 | |
| EP | 0923968 | A2 | * | 6/1999 | |
| GB | 2049447 | A | * | 12/1980 | ..... A63H/33/16 |
| IT | 586688 | A | * | 12/1958 | |
| WO | WO 8900069 | A1 | * | 1/1989 | ..... A63H/33/10 |
| WO | WO 200105479 | A1 | * | 1/2001 | ..... A63H/3/52 |

* cited by examiner

FOLDING STRUCTURE

CROSS-REFERENCE TO RELATED APPLICATIONS

This application is based upon and claims the benefit of U.S. Provisional Application No. 60/177,457, filed Jan. 20, 2000, the entire disclosure of which is incorporated herein by reference.

BACKGROUND OF THE INVENTION

The present invention relates to a foldable structure. More particularly, the present invention relates to a foldable doll house which is easily transformed between an assembled configuration and a folded configuration.

Doll houses are well known and are widely used. However, doll houses are traditionally and typically hard fastened, non-foldable structures that occupy a large amount of space and cannot be readily transported or conveniently stored.

There are doll houses which have been constructed so as to be capable of being disassembled. These doll houses, however, are typically provided with securing members such as screws, pegs and the like, which allow for the separation of all the component parts of the doll house. The drawback to this type of doll house is that the securing members are easily lost or misplaced.

Consequently, there is a need for doll houses which are easily transformed between an assembled configuration and a folded configuration to enable easy transportation and storage, while at the same time eliminating the use of securing members which can be easily misplaced.

SUMMARY OF THE INVENTION

It is an object of the present invention to provide a foldable structure which is easily transformed between an assembled configuration and a folded configuration.

It is another object of the present invention to provide a foldable structure which can be easily transported when in a folded configuration.

It is yet another object of the present invention to provide a foldable structure which is stable when assembled.

It is another object of the present invention to provide a foldable structure which does not require relatively small securing members to retain the structure in the assembled configuration.

It is still a further object of the present invention to provide a foldable structure whose footprint is capable of being enlarged.

According to the present invention, the foldable structure includes a main portion, a base panel which supports the main portion and a stabilizing panel which attaches to the main portion to stabilize the structure when in the assembled configuration.

In one embodiment, the main portion includes a major panel, a minor panel hingedly connected at its bottom edge to the top edge of the major panel, a first support panel hingedly connected to the left side edge of the minor panel, a second support panel hingedly connected to the right side edge of the minor panel, a left side panel hingedly connected to the left side edge of the major panel, and a right side panel hingedly connected to the right side edge of the major panel.

In this embodiment, the base panel has positioning members which engage the bottom edges of the left and right side panels when the foldable structure is in the assembled configuration. Additionally, the stabilizing panel has engaging members which secure the stabilizing panel to the top edges of the left and right side panels and to the bottom edges of the first and second support panels when the foldable structure is in the assembled configuration.

In another embodiment, the main portion includes a center panel, a left side panel hingedly connected substantially along the center thereof to the left side edge of the center panel, and a right side panel hingedly connected substantially along the center thereof to the right side edge of the center panel. With this embodiment, the main portion assumes a substantially H-shape when in the assembled configuration.

With this embodiment, the base panel has positioning members which engage the bottom edges of the left and right side panels when the foldable structure is in the assembled configuration so as to support the main portion. In this embodiment, the top edges of the left and right side panels each form a peak onto which a hinged upper panel is placed when the foldable structure is in the assembled configuration.

In a further embodiment, the main portion includes a front panel, a stabilizing panel hingedly connected at its bottom edge to the top edge of the front panel, a left side panel hingedly connected to the left side edge of the front panel, and a right side panel hingedly connected to the right side edge of the front panel.

With this embodiment, the base panel has positioning members which engage the bottom edges of the left and right side panels when the foldable structure is in the assembled configuration so as to support the main portion. In this embodiment, the top edges of the left and right side panels are inclined and an upper is placed on the inclined upper edges when the foldable structure is in the assembled configuration. The left and right side edges of the stabilizing panel are placed in respective grooves within the left and right side panels when the foldable structure is in the assembled configuration.

All embodiments may also include at least one removable intermediate section which is adapted to extend horizontally between the left side panel and the right side panel when the foldable structure is in the assembled configuration, and at least one removable dividing section which is adapted to extend vertically between at least one of the intermediate sections and the stabilizing section and/or the base panel when the foldable structure is in the assembled configuration. The intermediate sections and the dividing sections are used to partition the space defined by the assembled main portion.

Additionally, the base panels of each embodiment may also include additional positioning members which engage bottom edges of a second foldable structure adapted to be added to the main portion when the foldable structure is in the assembled configuration. The second foldable structure enables the easy expansion of the footprint of the foldable structure without the need to replace the entire structure.

In addition, each embodiment of the foldable structure is preferably provided with anti-tip members which secure the left side panel and the right side panel to the base panel. The use of anti-tip members assists in preventing the main portion of the foldable structure from tipping out of the positioning members of the base panel.

Further, a carrying case is preferably provided which accommodates the foldable structure in the folded configuration. The carrying case makes transportation of the structure convenient.

Other features and advantages of the present invention will become apparent from the following description of the invention which refers to the accompanying drawings.

DETAILED DESCRIPTION OF EMBODIMENTS OF THE INVENTION

The present invention is described herein with particular reference to a foldable doll house. This, however, is but one example of the type of structure for application of the present invention and it will be evident to one skilled in the art that other structures can be made in light of the following detailed description.

Figure 1:
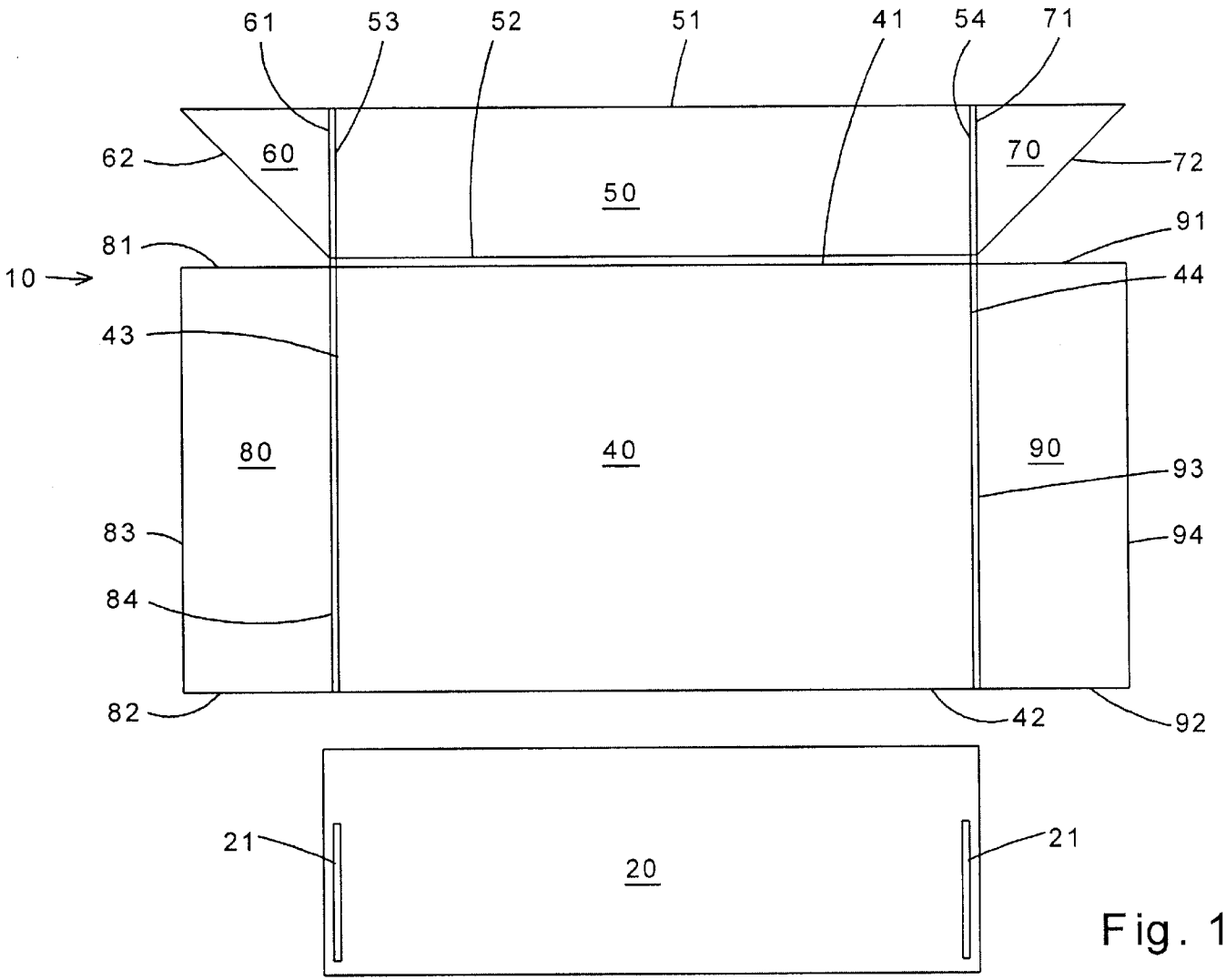
FIG. 1 is a top plan view of one embodiment of the foldable structure of the present invention in a flat, template configuration.

Referring now to the drawings, FIG. 1 shows the foldable doll house of the present invention in a flat, template configuration. The foldable doll house includes a main frame portion 10 which defines an interior of the doll house when the doll house is in an assembled configuration, a base panel 20 for mounting the main frame portion 10 thereupon, and an attic floor panel 30 (see FIG. 2) which stabilizes the doll house in the assembled configuration.

The main frame portion includes a front panel 40 having a top edge 41, a bottom edge 42, a left side edge 43 and a right side edge 44. A roof panel 50 having a top edge 51, a bottom edge 52, a left side edge 53 and a right side edge 54 is hingedly connected at its bottom edge 52 to the top edge 41 of the front panel 40. A first roof truss panel 60 having a front edge 61 and a bottom edge 62 is hingedly connected at its front edge 61 to the left side edge 53 of the roof panel 50. A second roof truss panel 70 having a front edge 71 and a bottom edge 72 is hingedly connected at its front edge 71 to the right side edge 54 of the roof panel 50. A left side panel 80 having a top edge 81, a bottom edge 82, a left side edge 83 and a right side edge 84 is hingedly connected at its right side edge 84 to the left side edge 43 of the front panel 40. A right side panel 90 having a top edge 91, a bottom edge 92, a left side edge 93 and a right side edge 94 is hingedly connected at its left side edge 93 to the right side edge 44 of the front panel 40.

Figure 4B:
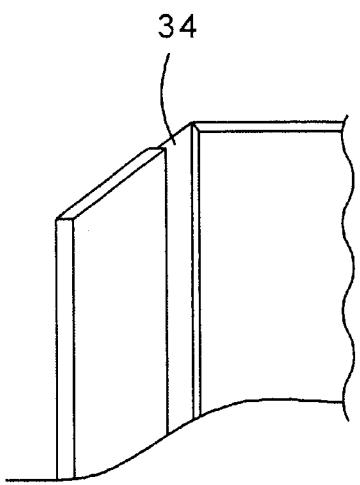
FIGS. 4A and 4B are perspective views showing two panels of the foldable structure attached by a web hinge.
Figure 3:
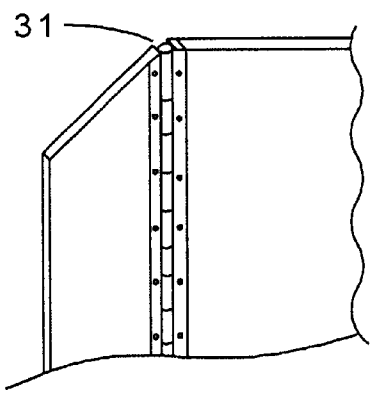
FIG. 3 is a perspective view showing two panels of the foldable structure attached by a piano hinge.
Figure 4A:
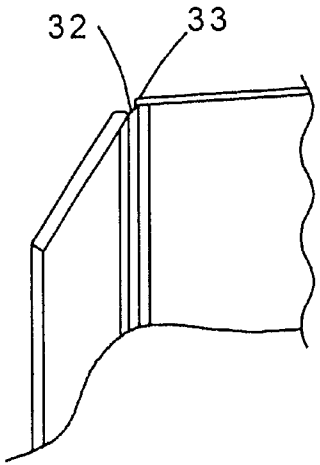

In order to hingedly connect the panels of the dollhouse together, a piano hinge 31, such as that shown in FIG. 3, may be used. Preferably, and as shown in FIG. 4B, the panels are hingedly connected together by a flexible web 34. This flexible web 34 is preferably formed from polyvinyl chloride (PVC), polyethylene, polypropylene, or any similar materials which allow the panels to pivot about the hinge structure. Additionally, and as shown in FIG. 4A, the flexible web 32 can include U-shaped receiving elements 33 which receive respective edges of the panels to be connected. The flexible web 32 with U-shaped receiving elements 33 is preferably formed from a one-piece extruded plastic material such as polyvinyl chloride (PVC), polyethylene, polypropylene, or any similar material which allows the panels to pivot about the hinge structure.

Next, a base panel 20 is provided for mounting of the assembled doll house. The base panel includes positioning members 21 located thereon so as to engage the bottom edges 82 and 92 of the left and right side panels when the doll house is in the assembled configuration. Preferably, the positioning members 21 are U-shaped channels which receive the bottom edges of the left side panel and the right side panel. Similar to the hinges described above, the positioning members 21 are also preferably extruded from PVC, polyethylene, polypropylene or other similar materials.

Figure 2:
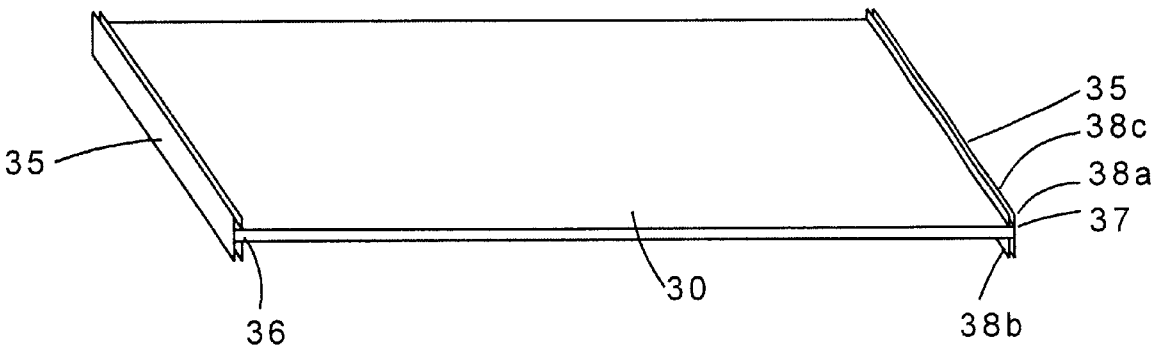
FIG. 2 is a perspective view of the stabilizing member of the present invention.

An attic floor panel 30, as shown in FIG. 2, is attached to the assembled dollhouse so as to stabilize the structure. The attic floor panel has engaging members 35 located thereon so as to secure the attic floor panel 30 to the top edges 81 and 91 of the left and right side panels 80 and 90 and to the bottom edges 62 and 72 of the first and second roof truss panels 60 and 70 when the doll house is in the assembled configuration. As shown in FIG. 2, the engaging members 35 are attached to the left 36 and right 37 edges of the attic floor panel 30.

Preferably, the engaging members 35 comprise T-shaped members wherein each portion of the T is a U-shaped receiving element which receives a respective edge of each panel to be secured together. As shown in FIG. 2, each engaging member 35 includes a first U-shaped element 38*a* which receives the edge of the attic floor panel 30, a second U-shaped element 38*b* which projects downwardly from the first element 38*a* and receives the top edge of the side panel and a third U-shaped element 38*c* which projects upwardly from the first element and receives the bottom edge of the roof truss panel.

Figure 5:
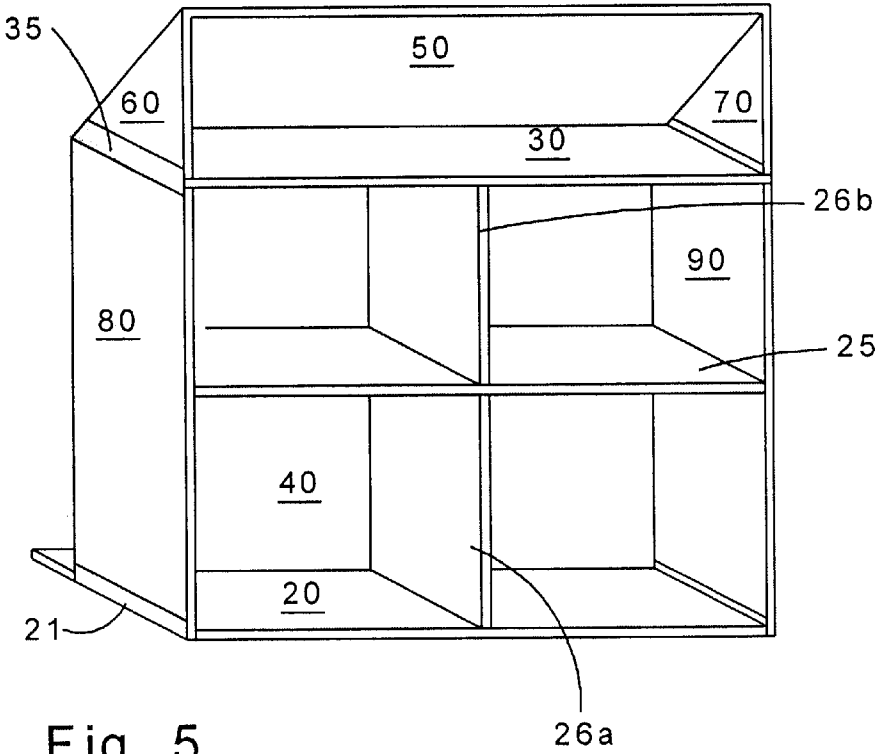
FIG. 5 is a perspective view showing the foldable structure of FIG. 1 in the assembled configuration.

As seen in FIG. 5, when the doll house is in the assembled configuration, interior floors and interior walls are then placed in their proper location. As shown, the doll house includes a slidably removable interior floor section 25 which is adapted to extend horizontally between the left side panel 80 and the right side panel 90 so as to separate the interior of the doll house into at least a first level and a second level. Further, in addition to the interior floor section 25, slidably removable interior first level 26*a* and second level 26*b* wall sections are provided. The first level and second level wall sections 26*a* and 26*b* are adapted to extend vertically between the interior floor section 25 and the base panel 20 and the interior floor section 25 and the attic floor panel 30, respectively.

Figure 6:
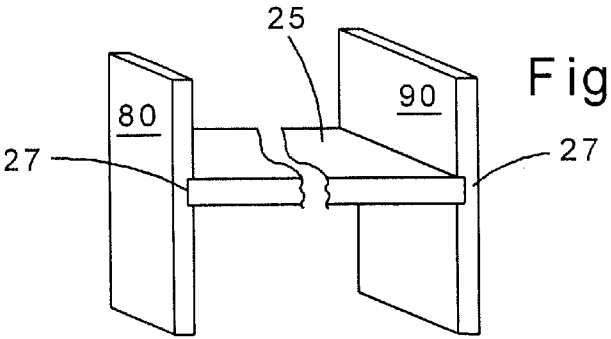
FIG. 6 is an exploded view showing the intermediate section of the present invention attached to the side panels by opposed grooves.

In order to have the interior wall and floor sections slidably removable, it is preferred that the interior floor and wall sections be slid into, and removable from, a pair of opposed grooves. As seen in FIG. 6, a pair of opposed grooves 27 are provided in the left side panel 80 and the right side panel 90, respectively. Each end of the interior floor section 25 is slid into one of the grooves 27. The grooves 27 provide support for the interior floor 25, thereby retaining it in its proper location. It will be evident that more than one interior floor section 25 can be provided in the interior of the doll house. Accordingly, for each interior floor to be placed in the doll house there will be a corresponding number of opposed grooves.

Figure 7:
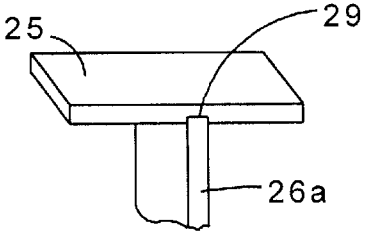
FIG. 7 is an exploded view showing the dividing section of the present invention attached to the intermediate section and the base panel by opposed grooves.
Figure 7:
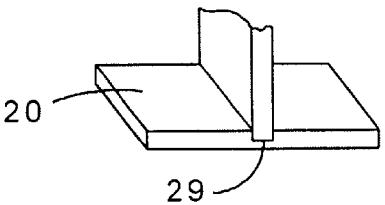

Similar to the interior floor section 25, the interior wall sections 26*a* and 26*b* are also preferably held in their proper location by pairs of opposed grooves and are slidably removable therefrom, as seen in FIG. 7. The first level interior 26*a* wall section is held in place by a pair of opposed grooves 29 located on the interior floor section 25 and the base panel 20, respectively. Although not shown, the second level interior wall section is held in place by a similar pair of opposed grooves located on the interior floor section and the attic floor panel, respectively. To properly place the interior wall sections 26*a* and 26*b* in their locations, the top and bottom edges of the wall sections are slid into their corresponding grooves.

Preferably, and as shown, the grooves only extend partly into their respective panels. This is to ensure that the structural integrity of each panel is not significantly compromised.

Figure 8:
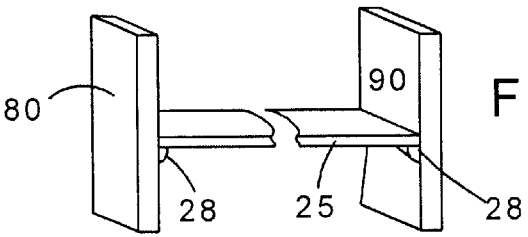
FIG. 8 is an exploded view showing the intermediate section of the present invention attached to the side panels by opposed supports.

Alternatively, the interior floor section 25 can be supported by a pair of opposed supports 28 located on the left side panel 80 and the right side panel 90, respectively, as shown in FIG. 8. Similar to the grooves, the interior floor section 25 is supported by the opposed supports 28 and slidably removable therefrom.

The use of slidably removable interior floor and wall sections generally increases the useable space within the interior of the dollhouse by eliminating any hinging arrangements for the interior sections. Also, the slidably removable interior sections allows the main frame of the doll house to be more compact when in the folded configuration.

Figure 10:
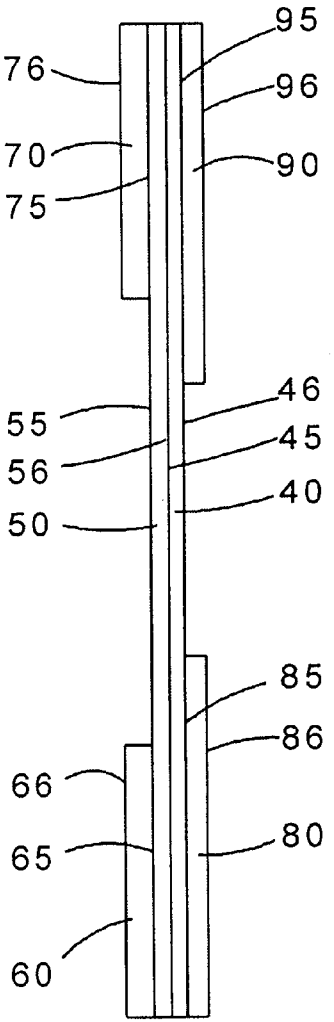
FIG. 10 is a side elevation showing the foldable structure of FIG. 1 in the folded configuration.
Figure 9:
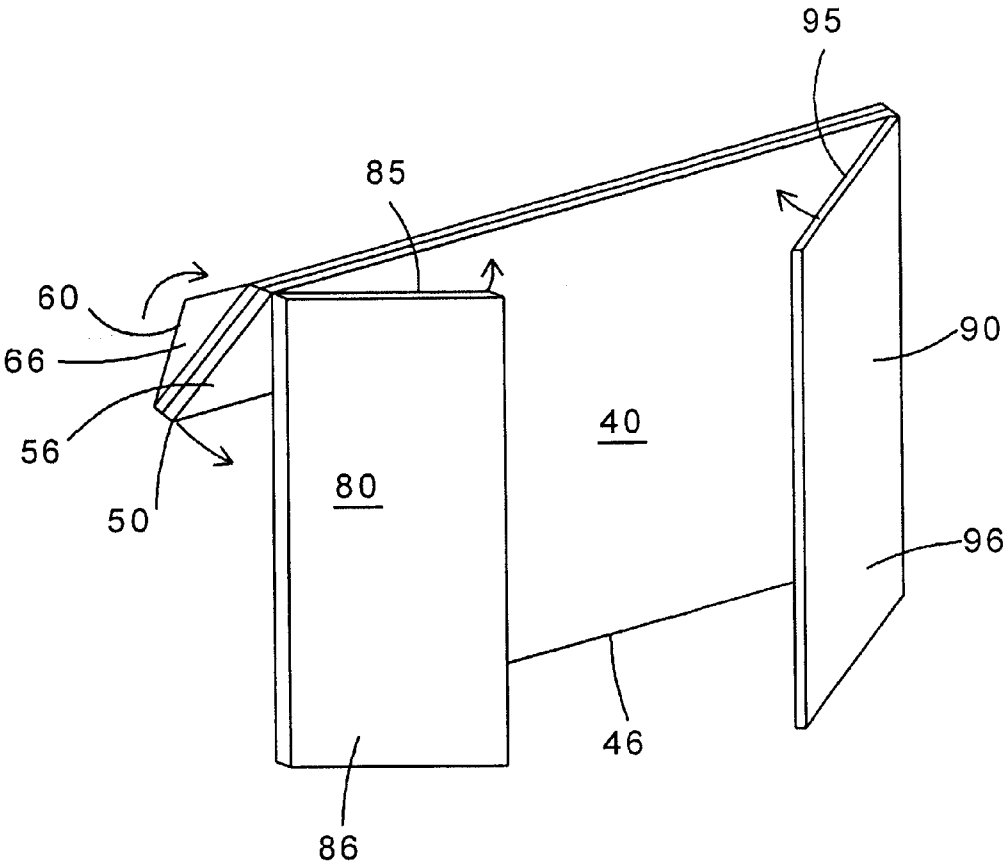
FIG. 9 is a perspective view showing the foldable structure of FIG. 1 as it is placed in the folded configuration.

To convert the doll house from the assembled configuration into the folded configuration, as shown in FIGS. 9 and 10, the outer face 56 of the roof panel 50 is displaced toward the outer face 45 of the front panel 40, the inner faces 65 and 75 of the first roof truss panel 60 and the second roof truss panel 70 are displaced toward the inner face 55 of the roof panel 50, and the inner faces 85 and 95 of the left side panel 90 and the right side panel are displaced toward the inner face 46 of the front panel.

Accordingly, and as shown in FIG. 10, when the foldable doll house is in the folded configuration, the outer face 56 of the roof panel 50 abuts the outer face 45 of the front panel 40, the inner faces 65 and 75 of the first roof truss panel 60 and the second roof truss panel 70 abut the inner face 55 of the roof panel 50, and the inner faces 85 and 95 of the left side panel 80 and the right side panel 90 abut the inner face 46 of the front panel 40.

It will be evident that, in order to convert the foldable doll house from the folded configuration into the assembled configuration, the panels are displaced opposite to that stated above. Namely, the outer face of the roof panel is displaced away from the outer face of the front panel, the inner faces of the first roof truss panel and the second roof truss panel are displaced away from the inner face of the roof panel, and the inner faces of the left side panel and the right side panel are displaced away from the inner face of the front panel.

Figure 12:
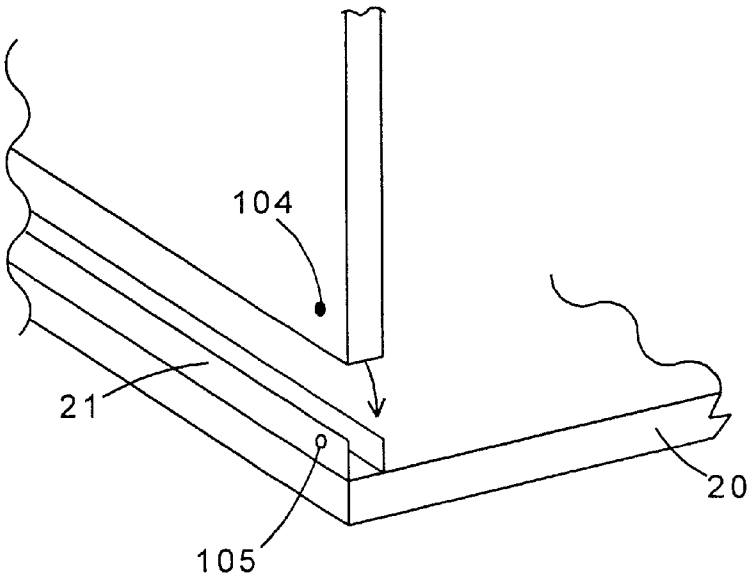
FIG. 12 is a perspective view showing a further embodiment of the anti-tip member of the present invention.
Figure 11:
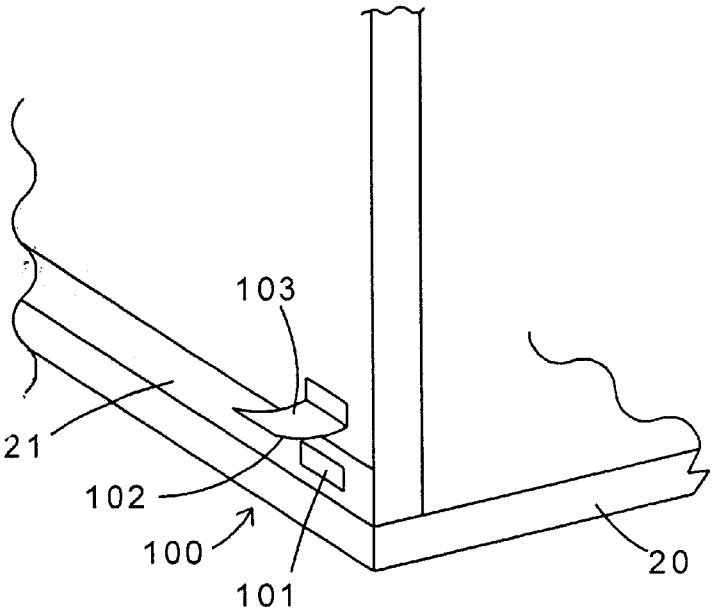
FIG. 11 is a perspective view showing one embodiment of the anti-tip member of the present invention.

Preferably, and as shown in FIGS. 11 and 12, the doll house of the present invention is provided with anti-tip members which secure the left side panel and the right side panel to the base panel. The use of anti-tip members assists in preventing the main frame portion of the doll house from tipping out of the positioning members of the base panel.

The anti-tip members can be designed as a hook-and-loop fastener arrangement 100, as shown in FIG. 11. As shown, the loop portion 101 of the fastener 100 is provided on the upwardly projecting portion of the U-shaped positioning member 21 and the hook portion 102 of the fastener 100 is provided on a fabric strip 103 which is attached to the outer surface of its respective side panel. When the bottom edges 82 and 92 of the left side panel 80 and the right side panel 90 are placed within their respective positioning members 21, the hook 102 and loop 101 portions of the fastener are engaged with each other.

It will be evident that more than one hook and loop fastener arrangement can be provided on the doll house and that the fastener arrangement can be on either the inside or outside surfaces of the side panels and positioning members, although only shown on the outside surface.

Further, and as shown in FIG. 12, the anti-tip members can be designed as rounded projections 104 which extend from outer surfaces of the left and right side panels and corresponding openings 105 in the upwardly projecting portion of the U-shaped positioning member 21. When the bottom edges of the left side panel and the right side panel are placed in their respective positioning members, the openings 105 in the positioning members 21 accept the rounded projection 104 of the side panels.

Similar to the hook and loop fastener arrangement, more than one set of rounded projections and openings can be provided on the doll house and they can be located on either the inside or outside surfaces of the side panels and positioning members, although only shown on the outside surface.

Figure 13:
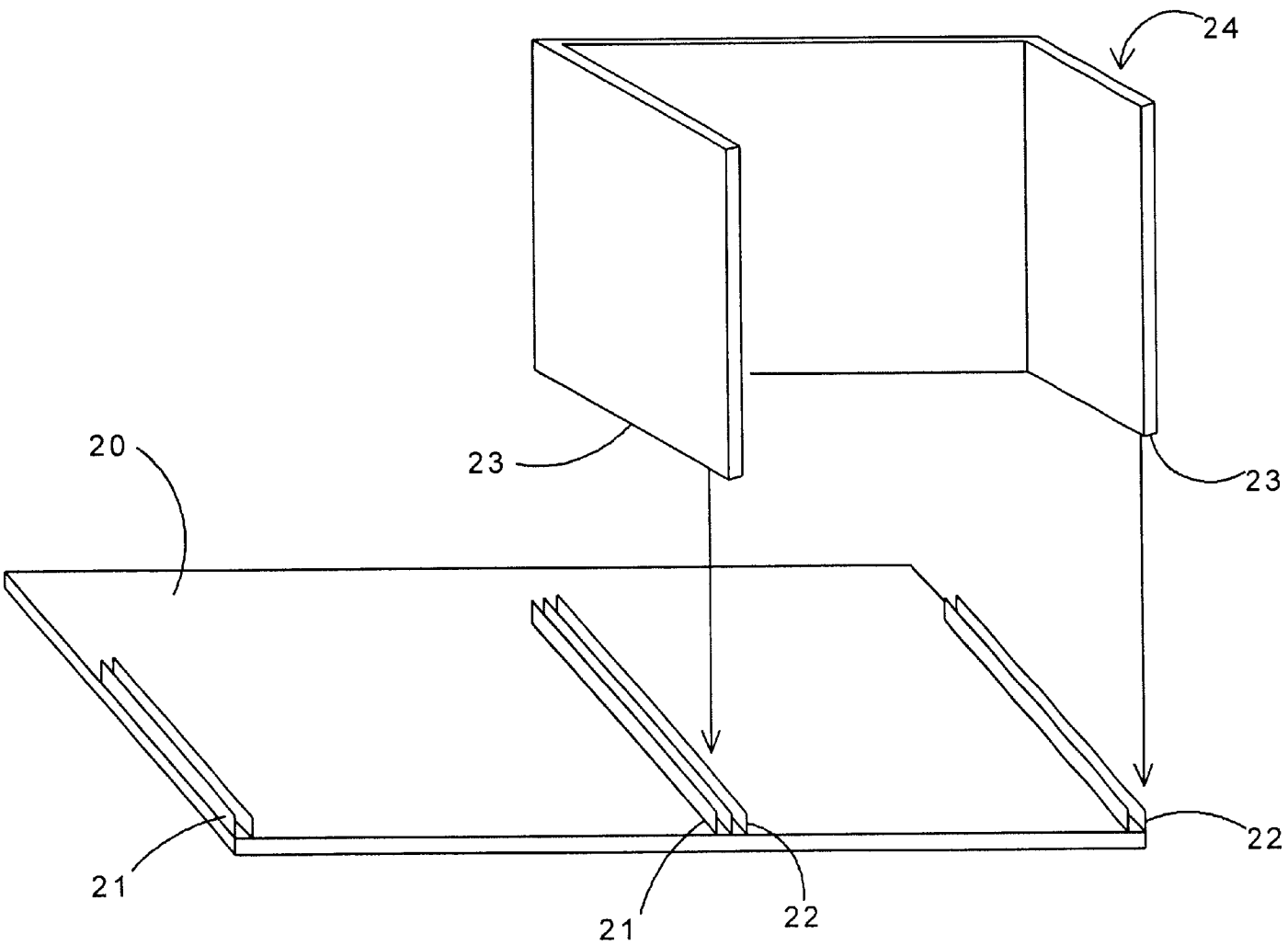
FIG. 13 is a perspective view showing a second foldable structure to be added to the foldable structure shown in FIG. 5.

Further, as shown in FIG. 13 the footprint of doll house of the present invention can be expanded by providing the base panel 20 with second positioning members 22 which engage bottom edges 23 of a foldable doll house extension 24. These second positioning members 22 can be provided on the base panel 20 or they can be provided on a replacement base panel which is substituted for the first base panel. Basically, as shown in FIG. 13, the foldable dollhouse extension 24 is adapted to be added to the main frame portion of the foldable doll house (not shown) attached to the first positioning members 21. The extension portion can be anything from a family room, den or sunroom to a garage.

Figure 14:
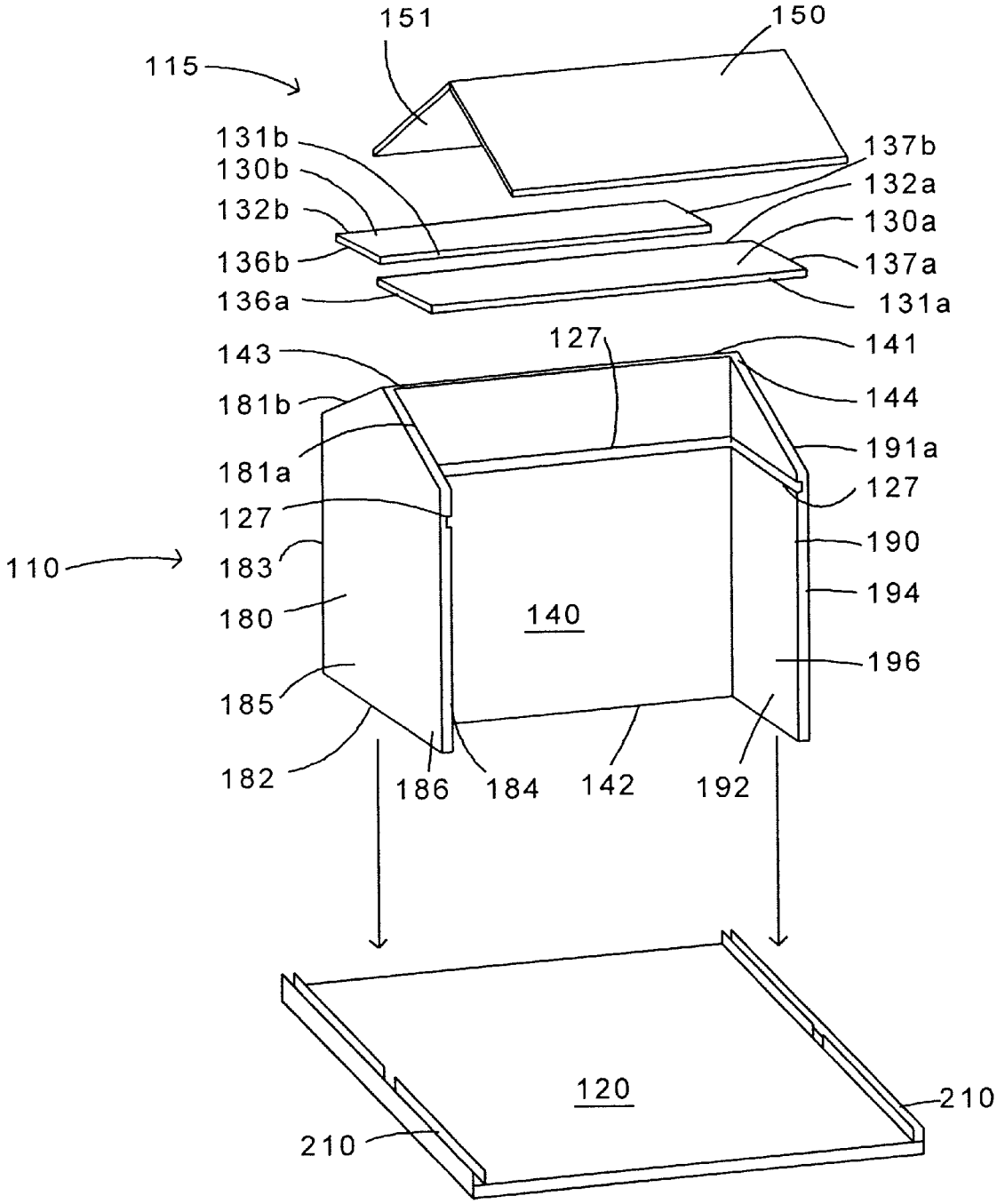
FIG. 14 is an exploded view showing a second embodiment of the foldable structure of the present invention.
Figure 16:
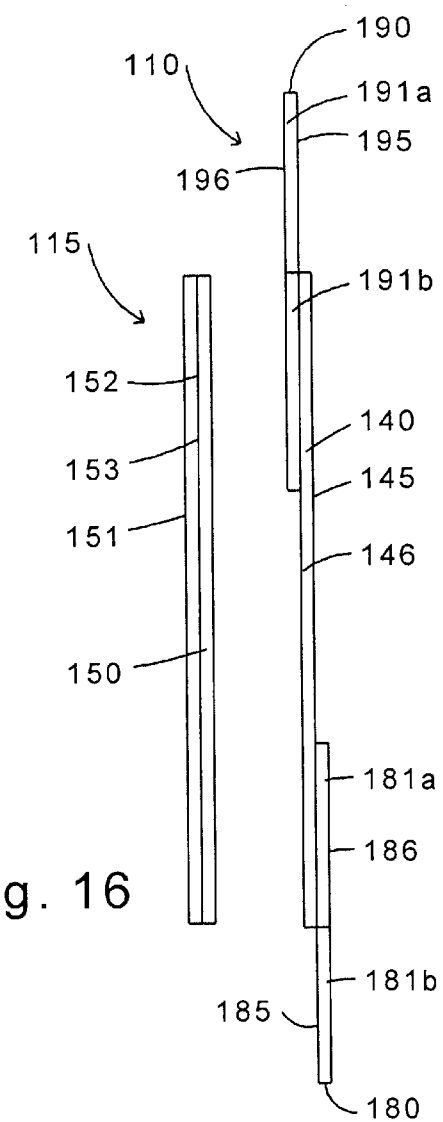
FIG. 16 is side elevation of the foldable structure of FIG. 14 in the folded configuration.
Figure 15:
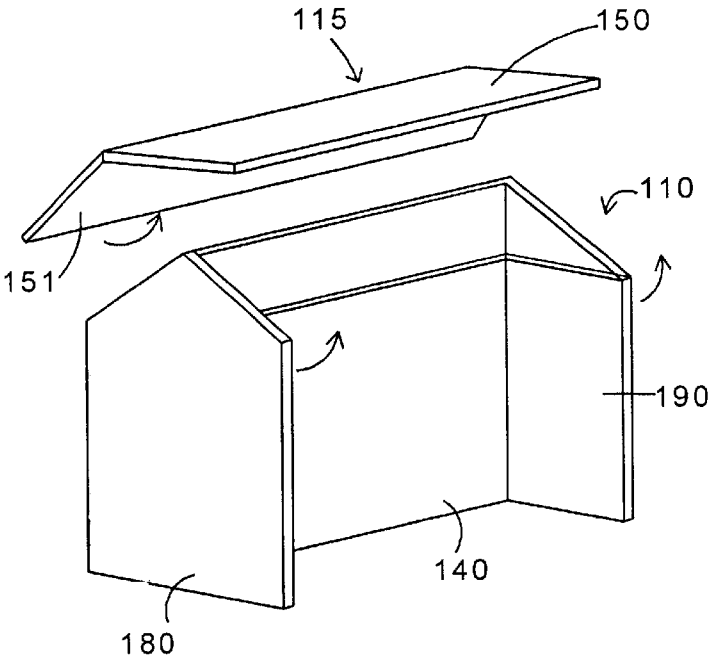
FIG. 15 is a perspective view showing the foldable structure of FIG. 14 as it is placed in the folded configuration.

Referring now to FIGS. 14–16, a second embodiment of the foldable doll house of the present invention will now be described. As shown, the second embodiment includes a main frame portion 110 which defines two opposed interior sections of the doll house, and a base panel 120 for mounting the main frame portion 110 thereupon.

The main frame portion includes a center panel 140 having a top edge 141, a bottom edge 142, a left side edge 143 and a right side edge 144. A left side panel 180 having an outer face 185 and an inner face 186 is hingedly connected to the left side edge 143 of the center panel 140 along the inner face 186 thereof. The left side panel 180 has a peaked top surface which forms two oppositely inclined top edges 181*a* and 181*b*, a bottom edge 182, a left side edge 183 and a right side edge 184. A right side panel 190 having an outer face 195 and an inner face 196 is hingedly connected to the right side edge 144 of the center panel 140 along the inner face 196 thereof. Similar to the left side panel 180, the right side panel 190 has a peaked top surface which forms two oppositely inclined top edges 191*a* and 191*b*, a bottom edge 192, a left side edge 193 and a right side edge 194. As seen in FIG. 14, when the main frame portion 110 is in the assembled configuration, it assumes a substantially H-shape, thereby forming two opposed interior sections of the doll house.

In order to hingedly connect the panels of the dollhouse together, the hinge structure can be a piano hinge such as that described above, or a flexible web may be attached between the inner surface of the side panels and one of the first or second faces of the center panel. The material of the flexible web can be polyvinyl chloride (PVC), polyethylene, polypropylene, fabric, or any similar materials which allow the panels to pivot relative to each other.

Similar to the first embodiment, the base panel 120 has positioning members 210 which engage the bottom edges 182 and 192 of the left and right side panels 180 and 190 when the doll house is in the assembled configuration. Preferably, the positioning members 210 are U-shaped channels which receive the bottom edges of the left side panel and the right side panel. The positioning members are preferably extruded from PVC, polyethylene, polypropylene or other similar materials.

Two attic floor panels 130*a* and 130*b*, one for each opposed interior section of the doll house, each having a front edge 131*a* and 131*b*, a back edge 132*a* and 132*b*, a left side edge 136*a* and 136*b* and a right side edge 137*a* and 137*b* are provided. Each attic floor panel 130*a* and 130*b* is slid into a pair of opposed grooves 127 provided on the inner surface 186 of the left side panel 180 and the inner surface 196 of the right side panel 190. In a preferred embodiment, as shown in FIG. 14, the groove 127 extends along the center panel 140 such that when each attic floor panel 130*a* and 130*b* is slid into the groove 127, the back edges 132*a* and 132*b* are slid into the portion of the groove 127 which extends along the center panel 140.

Thereafter, a roof portion 115 is placed across the top edges 181*a* and 181*b* and 191*a* and 191*b* of the side panels 180 and 190. The roof portion 115 includes two roof panel sections 150 and 151 which are hingedly connected together such that the hinged section aligns with the peak formed by the top edge 141 of the center panel 140.

When the doll house of the second embodiment is in the assembled configuration, interior floors and walls are then placed in their proper location similar to that described above for the first embodiment.

To convert the doll house from the assembled configuration into the folded configuration, as shown in FIGS. 15 and 16, the roof portion 115, the attic floor panels 130*a* and 130*b* and any interior floor and wall sections are first removed from the main frame portion 110. Thereafter, the inner face 185 of the left side panel 180 is displaced toward the first face 145 of the center panel. 140 and the inner face 195 of the right side panel 190 is displaced toward the second face 146 of the center panel 140 so as to place the main frame portion 110 in the folded configuration. Accordingly, when the doll house is in the folded configuration, as shown in FIG. 16, the inner face 185 of the left side panel 180 abuts the first face 145 of the center panel 140, and the inner face 195 of the right side panel 190 abuts the second face 146 of the center panel 140 to form the folded main frame portion 110. Also, the inner face 153 of roof panel section 151 is displaced toward the inner face 152 of roof panel section 150 such that the inner faces 152 and 153 of roof panel sections 150 and 151 abut when the roof portion 115 is in the folded configuration.

Similar to the first described embodiment, the base panel of the second embodiment can be provided with second positioning members which engage the bottom edges of a foldable doll house extension.

Additionally, it is preferred that the second embodiment also be provided with anti-tip members, such as those described above, which secure the left side panel and the right side panel to the base panel.

Figure 18:
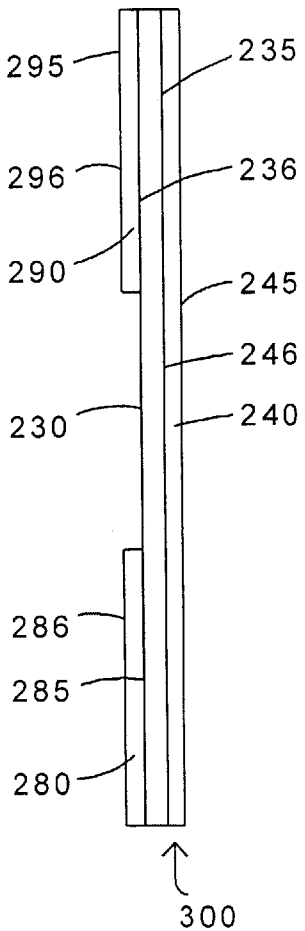
FIG. 18 is a side elevation of the foldable structure of FIG. 17 in the folded configuration.
Figure 17:
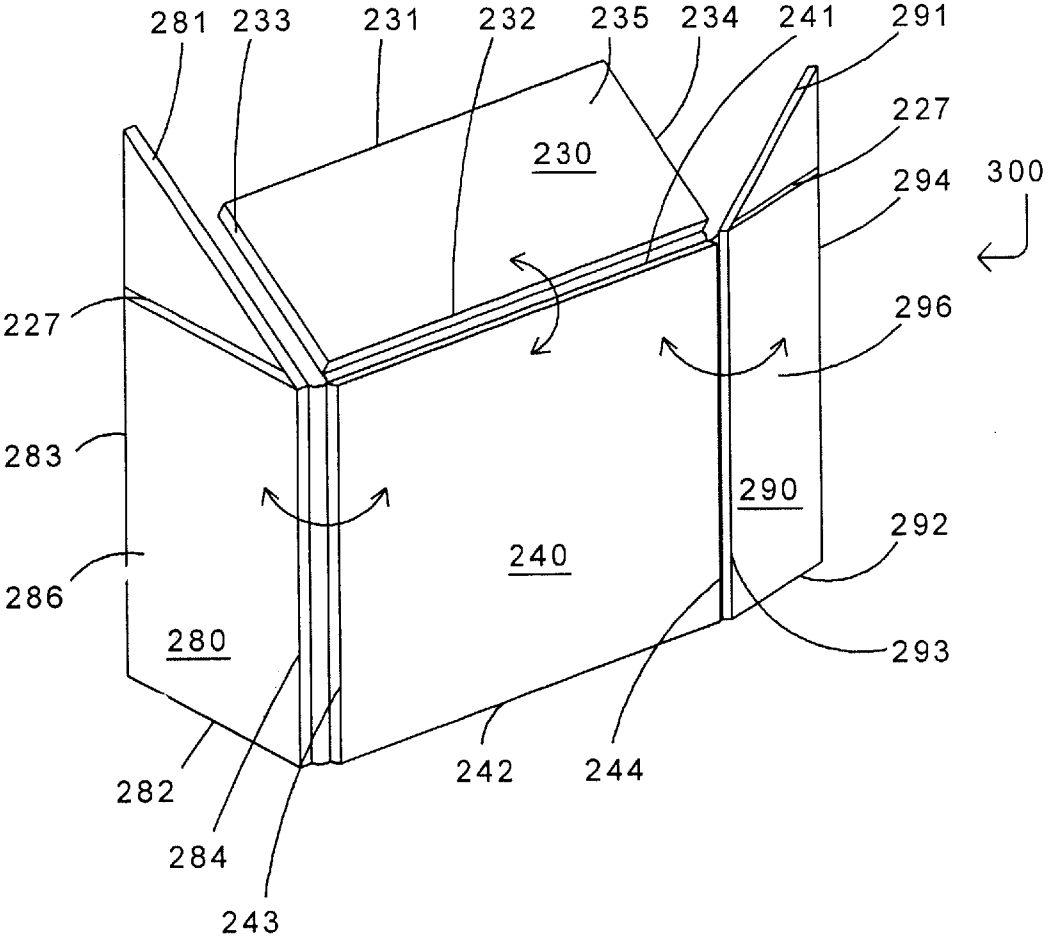
FIG. 17 is a perspective view showing a third embodiment of the foldable structure of the present invention as it is placed in the folded configuration.

Referring now to FIGS. 17–18, a third embodiment of the foldable doll house of the present invention will now be described. As shown, the third embodiment includes a main frame portion 300 which defines an interior of the doll house when the doll house is in an assembled configuration (similar to the first embodiment described above), and a base panel (not shown, and similar to those described for the first and second embodiments) for mounting the main frame portion 300 thereupon.

The main frame portion includes a front panel 240, and attic floor panel 230, a left side panel 280 and a right side panel 290. The front panel 240 has a top edge 241, a bottom edge 242, a left side edge 243 and a right side edge 244.

The attic floor panel 230 has a top edge 231, a bottom edge 232, a left side edge 233, a right side edge 234, an upper surface 235, and a lower surface 236. The attic floor panel 230 is hingedly connected to the top edge 241 of the front panel 240 along the bottom edge 232 thereof. The left side edge 233 and the right side edge 234 of the attic floor panel 230 are secured within a pair of opposed grooves 227 located on the inner faces 286 and 296 of the left and right side panels 280 and 290 when the doll house is in the assembled configuration.

The left side panel 280 has an outer face 285, an inner face 286, an inclined top edge 281, a bottom edge 282, a left side edge 283 and a right side edge 284. The left side panel 280 is hingedly connected to the left side edge 243 of the front panel 240 along the right side edge 284 thereof. The right side panel 290 has an outer face 295, an inner face 296, an inclined top edge 291, a bottom edge 292, a left side edge 293 and a right side edge 294. The right side panel 290 is hingedly connected to the right side edge 244 of the front panel 240 along the left side edge 293 thereof.

In order to hingedly connect the panels of the doll house together, a piano hinge 31, such as that shown in FIG. 3, may be used. Preferably, and as shown in FIG. 4B, the panels are hingedly connected together by a flexible web 34. This flexible web 34 is preferably formed from polyvinyl chloride (PVC), polyethylene, polypropylene, or any similar materials which allow the panels to pivot about the hinge structure. Additionally, and as shown in FIG. 4A, the flexible web 32 can include U-shaped receiving elements 33 which receive respective edges of the panels to be connected. The flexible web 32 with U-shaped receiving elements 33 is preferably formed from a one-piece extruded plastic material such as polyvinyl chloride (PVC), polyethylene, polypropylene, or any similar material which allows the panels to pivot about the hinge structure.

Although not shown in FIG. 17, the base panel, similar to the first and second embodiments, has positioning members which engage the bottom edges 282 and 292 of the left and right side panels 280 and 290 when the doll house is in the assembled configuration. Preferably, the positioning members are U-shaped channels which receive the bottom edges of the left side panel and the right side panel. The positioning members are preferably extruded from PVC, polyethylene, polypropylene or other similar materials.

When the doll house of the second embodiment is in the assembled configuration, interior floors and walls are then placed in their proper location similar to that described above for the first embodiment, and a single roof panel is attached to the top edges of the side panels (not shown).

To convert the doll house from the assembled configuration into the folded configuration, as shown in FIG. 18, the roof panel and the interior floor and wall sections are first removed from the main frame portion 300. Thereafter, the outer faces 285 and 295 of the left side panel 280 and the right side panel 290 are displaced toward the outer face 246 of the front panel 240 and the upper face 235 of the attic floor panel 230 is displaced toward the outer face 246 of the front panel 240 so as to place the main frame portion 300 in the folded configuration.

Accordingly, when the doll house is in the folded configuration, as shown in FIG. 18, the upper face 235 of the attic floor panel 230 abuts the outer face 246 of the front panel 240, and the outer faces 285 and 295 of the left side panel 280 and the right side panel 290 abut the lower face 236 of the attic floor panel. 230.

Similar to the first described embodiment, the base panel of the third embodiment can be provided with second positioning members which engage the bottom edges of a foldable doll house extension.

Additionally, it is preferred that the third embodiment also be provided with anti-tip members, such as those described above, which secure the left side panel and the right side panel to the base panel.

For all embodiments described, the panels and interior floor and wall sections of the doll house can be constructed from any desired material, such as, for example, plastic, wood and paperboard. Preferably, however, the panels and interior floor and wall sections are constructed from extruded PVC sheets. These extruded PVC sheets provide sufficient rigidity, durability and impart significantly less weight to the overall structure so as to make transportation convenient.

Figure 19:
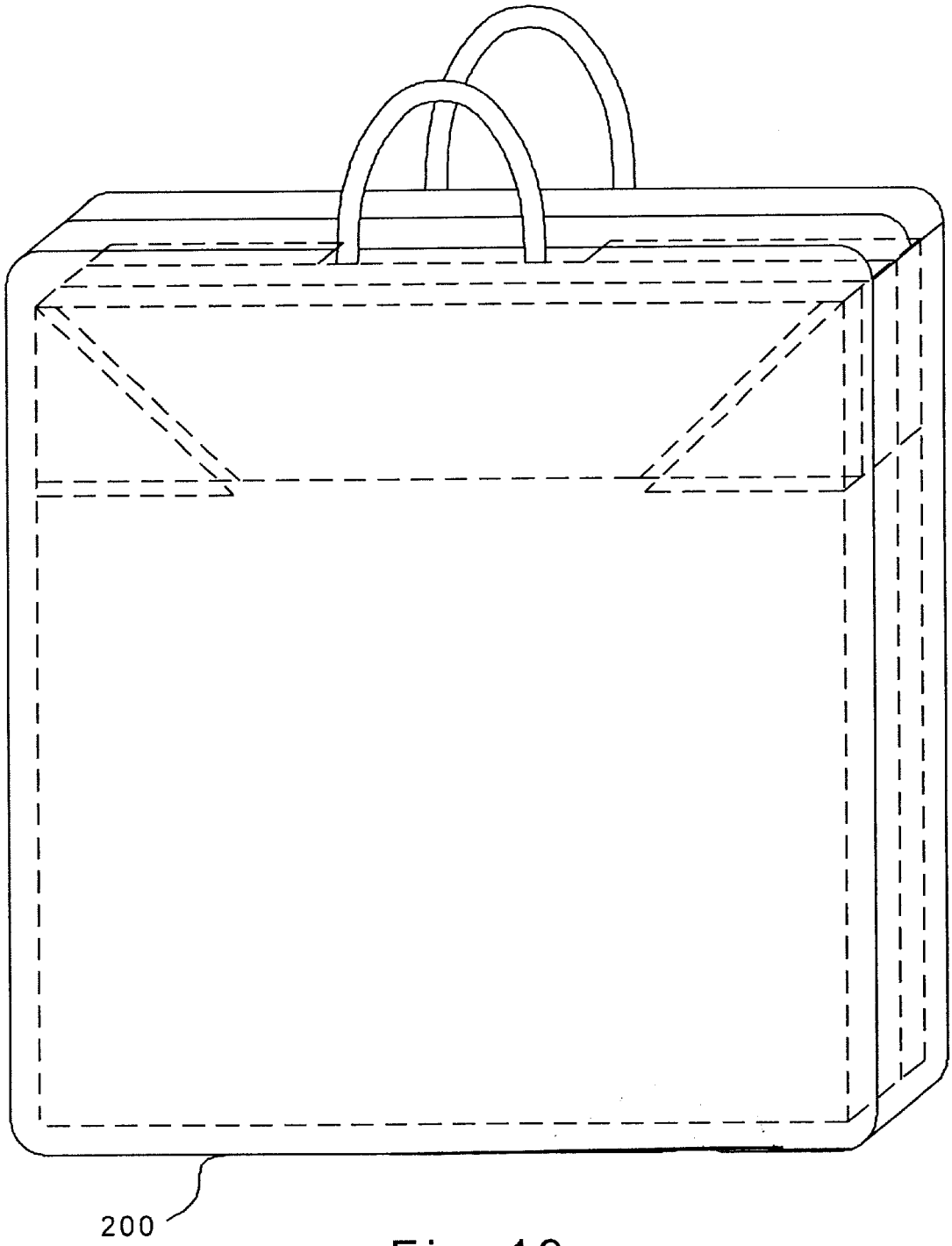
FIG. 19 is front perspective view of the foldable structure of the present invention within a carrying case.

Further, and as shown in FIG. 19, a carrying case 200 is provided which accommodates the doll house in the folded configuration. Preferably, the carrying case is designed so as to house all of the components of the doll house.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A foldable doll house having an assembled configuration and a folded configuration, the foldable doll house comprising:

a main frame portion which defines and interior of the doll house, the main frame portion including:

a front panel having a top edge, a bottom edge, a left side and a right side edge;

a roof panel having a top edge, a bottom edge, a left side edge and a right side edge, the roof panel being hingedly connected at its bottom edge to the top edge of the front panel;

a first roof truss panel having a front edge and a bottom edge, the front edge being hingedly connected to the left side edge of the roof panel;

a second roof truss panel having a front edge and a bottom edge, the front edge being hingedly connected to the right side edge of the roof panel;

a left side panel having a top edge, a bottom edge, a left side edge and a right side edge, the right side edge being hingedly connected to the left side edge of the front panel;

a right side panel having a top edge, a bottom edge, a left side edge and a right side edge, the left side edge being hingedly connected to the right side edge of the front panel;

a base panel having positioning members located so as to engage the bottom edges of the left and right side panels when the doll house is in the assembled configuration;

an attic floor panel having engaging members located so as to secure the attic floor panel to the to edges of the left and right side panels and to the bottom edges of the first and second roof truss panels when the doll house is in the assembled configuration; and wherein the positioning members are first positioning members, the structure further comprising second positioning members located on the base panel so as to engage bottom edges of a foldable doll house extension adapted to be added to the main frame portion.

2. The doll house of claim 1, further comprising:

at least one slidably removable interior floor section adapted to extend horizontally between the left side panel and the right side panel so as to separate the interior of the doll house into at least a first level and a second level;

at least one slidably removable interior first level wall section adapted to extend vertically between the interior floor section and the base panel; and at least one slidably removable interior second level wall section adapted to extend vertically between the interior floor section and the attic floor panel.

3. The doll house of claim 2, further comprising:

at least one pair of opposed grooves located on the left side panel and the right side panel, respectively, and wherein at least one of the interior floor sections is slid into one of the pairs of opposed grooves.

4. The doll house of claim 2, further comprising:

at least one pair of opposed supports located on the left side panel and the right side panel, respectively, and wherein the interior floor sections is supported by one of the pairs of opposed supports.

5. The doll house of claim 3, further comprising:

at least one pair of opposed grooves located on the interior floor section and the base panel, respectively, and wherein at least one of the interior first level wall sections is slid into one of die pairs of opposed grooves.

6. The doll house of claim 5, further comprising:

at least one pair of opposed grooves located on the interior floor section and the attic floor panel, respectively, and wherein at least one of the interior second level wall sections is slid into one of the pairs of opposed grooves.

7. The doll house of claim 1, further comprising a foldable doll house extension having bottom edges, the bottom edges being attached to the second positioning members of the base panel.

8. The doll house of claim 1, further comprising a carrying case sized so as to accommodate the doll house in the folded configuration.

9. The doll house of claim 1, wherein at least one hingedly connected panel is connected to another hingedly connected panel by a flexible web having U-shaped receiving elements which receive respective edges of the panels to be connected.

10. The doll house of claim 1, wherein at least one hingedly connected panel is connected to another hingedly connected panel by an extruded plastic web having U-shaped receiving elements which receive respective edges of the panels to be connected.

11. The doll house of claim 1, wherein the positioning members comprise U-shaped channels which receive the bottom edges of the left side panel and the right side panel.

12. The doll house of claim 1, further comprising anti-tip members which secure the left side panel and the right side panel to the base panel.

13. The doll house of claim 12, wherein the anti-tip members comprise a hook-and-loop fastener.

14. The doll house of claim 12, wherein the anti-tip members comprise a rounded projection extending from each side panel and an opening in the positioning member which accepts the rounded projection when the doll house is in the assembled configuration.

15. A foldable doll house having an assembled configuration and a folded configuration, the foldable doll house comprising:

a main frame portion which defines and interior of the doll house, the main frame portion including:

a front panel having a top edge, a bottom edge, a left side edge and a right side edge;

a roof panel having a top edge, a bottom edge, a left side edge and a right side edge, the roof panel being hingedly connected at its bottom edge to the top edge of the front panel;

a first roof truss panel having a front edge and a bottom edge, the front edge being hingedly connected to the left side edge of the roof panel;

a second roof truss panel having a front edge and a bottom edge, the front edge being hingedly connected to the right side edge of the roof panel;

a left side panel having a top edge, a bottom edge, a left side edge and a right side edge, the right side edge being hingedly connected to the left side edge of the front panel;

a right side panel having a top edge, a bottom edge, a left side edge and a right side edge, the left side edge being hingedly connected to the right side edge of the front panel;

a base panel having positioning members located so as to engage the bottom edges of the left and right side panels when the doll house is in the assembled configuration;

an attic floor panel having engaging members located so as to secure the attic floor panel to the top edges of the left and right side panels and to the bottom edges of the first and second roof truss panels when the doll house is in the assembled configuration:

wherein the engaging members comprise T-shaped members wherein each portion of the T is a U-shaped receiving element which receives a respective edge of each panel to be secured together.

16. The doll house of claim 15, wherein the positioning members are U-shaped channels which receive the bottom edges of the left side panel and the right side panel; the doll house further comprising:

anti-tip members which secure the left side panel and the right side panel to the base panel, the anti-tip members comprising a rounded projection extending from one of the left or right side panels and an opening in an upwardly projecting portion of the U-shaped channel which accepts the rounded projection when the doll house is in the assembled configuration.

17. A foldable doll house having an assembled configuration and a folded configuration, the foldable doll house comprising:

a main frame portion which defines and interior of the doll house, the main frame portion including:

a front panel having a top edge, a bottom edge, a left side edge and a right side edge;

a roof panel having a top edge, a bottom edge, a left side edge and a right side edge, the roof panel being hingedly connected at its bottom edge to the top edge of the front panel;

a first roof truss panel having a front edge and a bottom edge, the front edge being hingedly connected to the left side edge of the roof panel;

a second roof truss panel having a front edge and a bottom edge, the front edge being hingedly connected to the right side edge of the roof panel;

a left side panel having a top edge, a bottom edge, a left side edge and a right side edge, the right side edge being hingedly connected to the left side edge of the front panel;

a right side panel having a top edge, a bottom edge, a left side edge and a right side edge, the left side edge being hingedly connected to the right side edge of the front panel;

a base panel having positioning members located so as to engage the bottom edges of the left and right side panels when the doll house is in the assembled configuration;

an attic floor panel having engaging members located so as to secure the attic floor panel to the top edges of the left and right side panels and to the bottom edges of the first and second roof truss panels when the doll house is in the assembled configuration;

wherein the front panel includes and outer face and an inner face; the roof panel includes an outer face and an inner face; the first roof truss panel includes an outer face and an inner face; the second roof truss panel includes and outer face and an inner face; the left side panel includes an outer face and an inner face; and the right side panel includes an outer face and an inner face; and wherein, the outer face of the roof panel is displaced toward the outer face of the front panel, the inner faces of the first roof truss panel and the second roof truss panel are displaced toward the inner face of the roof panel, and the inner faces of the left side panel and the right side panel are displaced toward the inner face of the front panel when the foldable doll house is converted from the assembled configuration into the folded configuration.

18. A foldable doll house having an assembled configuration and a folded configuration the foldable doll house comprising:

a main frame portion which defines and interior of the doll house, the main frame portion including:

a front panel having a top edge, a bottom edge, a left side edge and a right side edge;

a roof panel having a top edge, a bottom edge, a left side edge and a right side edge, the roof panel being hingedly connected at its bottom edge to the top edge of the front panel;

a first roof truss panel having a front edge and a bottom edge, the front edge being hingedly connected to the left side edge of the roof panel;

a second roof truss panel having a front edge and a bottom edge, the front edge being hingedly connected to the right side edge of the roof panel;

a left side panel having a top edge, a bottom edge, a left side edge and a right side edge, the right side edge being hingedly connected to the left side edge of the front panel;

a right side panel having a top edge, a bottom edge, a left side edge and a right side edge, the left side edge being hingedly connected to the right side edge of the front panel;

a base panel having positioning members located so as to engage the bottom edges of the left and right side panels when the doll house is in the assembled configuration;

an attic floor panel having engaging members located so as to secure the attic floor panel to the top edges of the left and right side panels and to the bottom edges of the first and second roof truss panels when the doll house is in the assembled configuration;

wherein the front panel includes an outer face and an inner face; the roof panel includes and outer face and an inner face; the first roof truss panel includes an outer face and an inner face; the second roof truss panel includes an outer face and an inner face; the left side panel includes an outer face and an inner face; and the right side panel includes an outer face and an inner face; and wherein, the outer face of the roof panel abuts the outer face of the front panel, the inner faces of the first roof truss panel and the second roof truss panel abut the inner face of the roof panel, and the inner faces of the left side panel and the right side panel abut the inner face of the front panel when the foldable doll house is in the folded configuration.

19. A foldable doll house having an assembled configuration and a folded configuration the foldable doll house comprising:

a main fame portion which defines two opposed interior sections of the doll house, the main fame portion including:

a center panel having a top edge, a bottom edge, a left side edge and a right side edge;

a left side panel having an outer face, an inner face, two oppositely inclined top edges, a bottom edge, a left side edge and a right side edge the inner face being hingedly connected to the left side edge of the center panel;

a right side panel having an outer face, an inner face, two oppositely inclined top edges, a bottom edge, a left side edge and a right side edge, the inner face being hingedly connected to the right side edge of the center panel;

a base panel having positioning members located so as to engage the bottom edges of the left and right side panels when the doll house is in the assembled configuration;

at least one slidably removable interior floor section adapted to extend horizontally between the left side panel and the right side panel so as to separate at least one of the two opposed interior sections of the doll house into at least a first level and a second level;

at least one slidably removable interior first level wall section adapted to extend vertically between the interior floor section and the base panel;

at least one slidably removable interior second level wall section adapted to extend vertically between the interior floor section and the attic floor panel; and further comprising:

at least one pair of opposed supports located on the left side panel and the right side panel, respectively, and wherein the interior floor sections is supported by one of the pairs of opposed supports.

20. The doll house of claim 19, further including at least one attic floor panel adapted to extend horizontally between the left side panel and the right side panel so as to define an attic level within at least one of the two opposed interior sections of the doll house.

21. The doll house of claim 20, further comprising:

at least one pair of opposed grooves located on the left side panel and the right side panel, respectively, and wherein at least one of the attic floor panels is slid into one of the pairs of opposed grooves.

22. The doll house of claim 19, further comprising:

at least one pair of opposed grooves located on the left side panel and the right side panel, respectively, and wherein at least one of the interior floor sections is slid into one of the pair of opposed grooves.

23. The doll house of claim 22, further comprising:

at least one pair of opposed grooves located on the interior floor section and the base panel, respectively, and wherein at least one of the interior first level wall sections is slid into one of the pairs of opposed grooves.

24. The doll house of claim 23, further comprising:

at least one pair of opposed grooves located on the interior floor section and the attic floor panel, respectively, and wherein at least one of the interior second level wall sections is slid into one of the pairs of opposed grooves.

25. The doll house of claim 19, further comprising a carrying case sized so as to accommodate the doll house in the folded configuration.

26. The doll house of claim 19, wherein at least one hingedly connected panel is connected to another hingedly connected panel by a flexible web having U-shaped receiving elements which receive respective edges of the panels to be connected.

27. The doll house of claim 19, wherein at least one hingedly connected panel is connected to another hingedly connected panel by an extruded plastic web having U-shaped receiving elements which receive respective edges of the panels to be connected.

28. The doll house of claim 19, wherein the positioning members comprise U-shaped channels which receive the bottom edges of the left side panel and the right side panel.

29. The doll house of claim 19, further comprising anti-tip members which secure the left side panel and the right side panel to the base panel.

30. The doll house of claim 29, wherein the anti-tip members comprise a hook-and-loop fastener.

31. The doll house of claim 29, wherein the anti-tip members comprise a rounded projection extending from each side panel and an opening in the positioning member which accepts the rounded projection when the doll house is in the assembled configuration.

32. The doll house of claim 19, wherein the positioning members are U-shaped channels which receive the bottom edges of the left side panel and the right side panel; the doll house further comprising:

anti-tip members which secure the left side panel and the right side panel to the base panel, the anti-tip members comprising a rounded projection extending from one of the left or right side panels and an opening in an upwardly projecting portion of the U-shaped channel which accepts the rounded projection when the doll house is in the assembled configuration.

33. A foldable doll house having an assembled configuration and a folded configuration, the foldable doll house comprising:

a main frame portion which defines two opposed interior sections of the doll house, the main frame portion including:

a center panel having a top edge, a bottom edge, a left side edge and a right side edge;

a left side panel having an outer face, an inner face, two oppositely inclined top edges, a bottom edge, a left side edge and a right side edge, the inner face being hingedly connected to the left side edge of the center panel;

a right side panel having an outer face, an inner face, two oppositely inclined top edges, a bottom edge, a left side edge and a right side edges the inner face being hingedly connected to the right side edge of the center panel;

a base panel having positioning members located so as to engage the bottom edges of the left and right side panels when the doll house is in the assembled configuration; and wherein the positioning members are first positioning members, the structure further comprising second positioning members located on the base panel so as to engage bottom edges of a foldable doll house extension adapted to be added to the main frame portion.

34. The doll house of claim 33, further comprising a foldable doll house extension having bottom edges, the bottom edges being attached to the second positioning members of the base panel.

35. A foldable doll house having an assembled configuration and a folded configuration, the foldable doll house comprising:

a main frame portion which defines two opposed interior sections of the doll house, the main frame portion including:

a center panel having a top edge, a bottom edge, a left side edge and a right side edge;

a left side panel having an outer face, an inner face, two oppositely inclined top edges, a bottom edge, a left side edge and a right side edge, the inner face being hingedly connected to the left side edge of the center panel;

a right side panel having an outer face, an inner face, two oppositely inclined top edges, a bottom edge, a left side edge and a right side edge, the inner face being hingedly connected to the right side edge of the center panel;

a base panel having positioning members located so as to engage the bottom edges of the left and right side panels when the doll house is in the assembled configuration;

wherein the center panel includes a first face and a second face; and wherein, the inner face of the left side panel is displaced toward the first face of the center panel, and the inner face of the right side panel is displaced toward the second face of the center panel when the foldable doll house is converted from the assembled configuration into the folded configuration.

36. A foldable doll house having an assembled configuration and a folded configuration, the foldable doll house comprising:

a main frame portion which defines two opposed interior sections of the doll house, the main frame portion including:

a center panel having a top edge, a bottom edge, a left side edge and a right side edge;

a left side panel having an outer face, an inner face, two oppositely inclined top edges, a bottom edge, a left side edge and a right side edge the inner face being hingedly connected to the left side edge of the center panel;

a right side panel having an outer face, an inner face, two oppositely inclined top edges, a bottom edge, a left side edge and a right side edge, the inner face being hingedly connected to the right side edge of the center panel; a base panel having positioning members located so as to engage the bottom edges of the left and right side panels when the doll house is in the assembled configuration;

wherein the center panel includes a first face and a second face; and wherein, the inner face of the left side panel abuts the first face of the center panel, and the inner face of the right side panel abuts the second face of the center panel when the foldable doll house is in the folded configuration.

37. A foldable doll house having an assembled configuration and a folded configuration, the foldable doll house comprising:

a main frame portion which defines and interior of the doll house, the main frame portion including:

a front panel having a top edge, a bottom edge, a left side edge and right side edge, an attic floor panel having a top edge, a bottom edge, a left side edge and a right side edge, the attic floor panel being hingedly connected at its bottom edge to the top edge of the front panel;

a left side panel having a top edge, a bottom edge, a left side edge and a right side edge, the right side edge being hingedly connected to the left side edge of the front panel;

a right side panel having a top edge, a bottom edge, a left side edge and right side edge, the left side edge being hingedly connected to the right side edge of the front panel;

a pair of opposed grooves located on the left side panel and the right side panel, respectively, the pair of opposed grooves adapted to engage the left side edge and the right side edge of the attic floor panel when the doll house is in the assembled configuration;

a base panel having positioning members located so as to engage the bottom edges of the left and right side panels when the doll house is in the assembled configuration; and wherein the positioning members are first positioning members, the structure further comprising second positioning members located on the base panel so as to engage bottom edges of a foldable doll house extension adapted to be added to the main frame portion.

38. The doll house of claim 37, further comprising a roof section attached above the attic floor panel.

39. The doll house of claim 37, further comprising:

at least one slidably removable interior floor section adapted to extended horizontially between the left side panel and the right side panel so as to separate the interior of the doll house into at least a first level and a second level;

at least one slidably removable interior first level wall section adapted to extend vertically between the interior floor section and the base panel; and at least one slidably removable interior second level wall section adapted to extend vertically between the interior floor section and the attic floor panel.

40. The doll house of claim 39, further comprising:

at least one pair of opposed grooves located on the left side panel and the right side panel, respectively, and wherein at least one of the interior floor sections is slid into one of the pairs of opposed grooves when the dollhouse is in the assembled configuration.

41. The doll house of claim 39, further comprising:

at least one pair of opposed supports located on the left side panel and the right side panel, respectively, and wherein the interior floor sections is supported by one of the pairs of opposed supports.

42. The doll house of claim 40, further comprising:

at least one pair of opposed grooves located on the interior floor section and the base panel, respectively, and wherein at least one of the interior fist level wall sections is slid into one of the pairs of opposed grooves.

43. The doll house of claim 42, further comprising:

at least one pair of opposed grooves located on the interior floor section and the attic floor panel, respectively, and wherein at least one of the interior second level wall sections is slid into one of the pairs of opposed grooves.

44. The doll house of claim 37, further comprising a foldable doll house extension having bottom edges, the bottom edges being attached to the second positioning members of the base panel.

45. The doll house of claim 37, further comprising a carrying case sized so as to accommodate the doll house in the folded configuration.

46. The doll house of claim 37, wherein at least one hingedly connected panel is connected to another hingedly connected panel by a flexible web.

47. The doll house of claim 46, wherein the flexible web includes U-shaped receiving elements which receive respective edges of the panels to be connected.

48. The doll house of claim 37, wherein the positioning members comprise U-shaped channels which receive the bottom edges of the left side panel and the right side panel.

49. The doll house of claim 37, further comprising anti-tip members which secure the left side panel and the right side panel to the base panel.

50. The doll house of claim 49, wherein the anti-tip members comprise a book-and-loop fastener.

51. The doll house of claim 49, wherein the anti-tip members comprise a rounded projection extending from each side panel and opening in the positioning member which accepts the rounded projection when the doll house is in the assembled configuration.

52. The doll house of claim 37, wherein the positioning members are U-shaped channels which receive the bottom edges of the left side panel and the right side panel; the doll house further comprising:

anti-tip members which secure the left side panel and the right side panel to the base panel, the anti-tip members comprising a rounded projection extending from one of the left or right side panels and an opening in an upwardly projecting portion of the U-shaped channel which accepts the rounded projection when the doll house is in the assembled configuration.

53. A foldable doll house having an assembled configuration and a folded configuration the foldable doll house comprising:

a main frame portion which defines and interior of the doll house, the main frame portion including:

a front panel having a top edge, a bottom edge, a left side edge and a right side edge, an attic floor panel having a top edge, a bottom edge, a left side edge and right side edge, the attic floor panel being hingedly connected at its bottom edge to the top edge of the front panel;

a left side panel having a top edge, a bottom edge, a left side edge and a right side edge, the right side edge being hingedly connected to the left side edge of the front panel;

a right side panel having a top edge, a bottom edge, a left side edge and right side edge, the left side edge being hingedly connected to the right side edge of the front panel;

a pair of opposed grooves located on the left side panel and the right side panel, respectively, the pair of opposed grooves adapted to engage the left side edge and the right side edge of the attic floor panel when the doll house is in the assembled configuration;

a base panel having positioning members located so as to engage the bottom edges of the left and right side panels when the doll house is in the assembled configuration;

wherein the front panel includes an outer face and an inner face; the attic floor panel includes an upper face and a lower face; the left side panel includes an outer face and an inner face; and the right side panel includes an outer face and an inner face; and wherein, the upper face of the attic floor panel is displaced toward the outer face of the front panel, and the outer faces of the left side panel and the right side panel are displaced toward the outer face of the front panel when the foldable doll house is converted from the assembled configuration into the folded configuration.

54. A foldable doll house having an assembled configuration and a folded configuration, the foldable doll house comprising:

a main frame portion which defines and interior of the doll house, the main frame portion including:

a front panel having a top edge, a bottom edge, a left side edge and a right edge, an attic floor panel having a top edge, a bottom edge, a left side edge and a right side edge, the attic floor panel being hingedly connected at its bottom edge to the top edge of the front panel;

a left side panel having a top edge, a bottom edge, a left side edge and a right side edge, the right side edge being hingedly connected to the left side edge of the front panel;

a right side panel having a top edge, a bottom edge, a left side edge and right side edge, the left side edge being hingedly connected to the right side edge of the front panel;

a pair of opposed grooves located on the left side panel and the right side panel, respectively, the pair of opposed grooves adapted to engage the left side edge and the right side edge of the attic floor panel when the doll house is in the assembled configuration;

a base panel having positioning members located so as to engage the bottom edges of the left and right side panels when the doll house is in the assembled configuration;

wherein the front panel includes an outer face and an inner face; the attic floor panel includes an upper face and a lower face; the left side panel includes an outer face and an inner face; and the right side panel includes and outer face and an inner face; and wherein, the upper face of the attic floor panel abuts the outer face of the front panel, and the outer faces of the left side panel and the right side panel abut the lower face of the attic floor panel when the foldable doll house is in the folded configuration.

55. A foldable doll house having an assembled configuration and a folded configuration, the foldable doll house comprising:

a main frame portion which defines an interior of the doll house, the main frame portion including:

a front panel having a top edge, a bottom edge, a left side edge and a right side edge;

a left side panel having a tap edge, a bottom edge, a left side edge and a right side edge, the right side edge being hingedly connected to the left side edge of the front panel;

a right side panel having a top edge, a bottom edge, a left side edge and a right side edge, the left side edge being hingedly connected to the right side edge of the front panel;

a base panel having positioning members located so as to engage the bottom edges of the left and right side panels when the doll house is in the assembled configuration;

wherein the positioning members are first positioning members, the structure further comprising second positioning members located on the base panel so as to engage bottom edges of a foldable doll house extension adapted to be added to the main frame portion; and further comprising a foldable doll house extension having bottom edges, the bottom edges being attached to the second positioning members of the base panel.

56. The doll house of claim 55, further comprising a carrying case sized so as to accommodate the doll house in the folded configuration.

57. The doll house of claim 55, wherein at least one hingedly connected panel is connected to anther hingedly connected panel by a flexible web having U-shaped receiving elements which receive respective edges of the panels to be connected.

58. The doll house of claim 55, wherein at least one hingedly connected panel is connected to anther hingedly connected panel by an extruded plastic web having U-shaped receiving elements which receive respective edges of the panels to be connected.

59. The doll house of claim 55, wherein the positioning members comprise U-shaped channels which receive the bottom edges of the left side panel and the right side panel.

60. The doll house of claim 55, further comprising anti-tip members which secure the left side panel and the right side panel to the base panel.

61. The doll house of claim 60, wherein the anti-tip members comprise a hook-and-loop fastener.

62. The doll house of claim 60, wherein the anti-tip members comprise a rounded projection extending from each side panel and an opening in the positioning member which accepts the rounded projection when the doll house is in the assembled configuration.

63. The doll house of claim 55, wherein the positioning members are U-shaped channels which receive the bottom edges of the left side panel and the right side panel; the doll house further comprising:

anti-tip members which secure the left side panel and the right side panel to the base panel, the anti-tip members comprising a rounded projection extending from one of the left or right side panels and an opening in an upwardly projecting portion of the U-shaped channel which accepts the rounded projection when the doll house is in the assembled configuration.

64. The doll house of claim 55, wherein the front panel includes an outer face and an inner face; the left side panel includes an outer face and an inner face, and the right side panel includes an outer face and an inner face, the inner faces of the left side panel and the right side panel being displaced toward the inner face of the front panel when the foldable doll house is converted from the assembled configuration into the folded configuration.

65. The doll house of claim 55, wherein the front panel includes an outer face and an inner face; the left side panel includes an outer face and an inner face; and the right side panel includes an outer face and an inner face, the inner faces of the left side panel and the right side panel abutting the inner face of the front panel when the foldable doll house is in the folded configuration.

* * * * *